US005871348A

United States Patent [19]

Terry et al.

[11] Patent Number: 5,871,348

[45] Date of Patent: Feb. 16, 1999

[54] METHOD AND APPARATUS FOR PREVENTING FORMATION OF SNOWMEN AND REMOVING LUMPS OF COATING IN CLINKER COOLERS

[75] Inventors: Mark S. Terry, Roswell; Oleg Geskin, Marietta; Herbert Pingel, Hiram, all of Ga.

[73] Assignee: Krupp Polysius AG, Beckum, Germany

[21] Appl. No.: 966,813

[22] Filed: Nov. 10, 1997

Related U.S. Application Data

[63] Continuation of Ser. No. 573,222, Dec. 15, 1995, abandoned.

[51] Int. Cl.[6] ..... F27D 15/02; F23H 1/02

[52] U.S. Cl. ..... 432/78; 432/77; 126/163 R

[58] Field of Search ..... 432/77, 78; 126/163 R; 110/278, 281, 282, 283, 288, 289, 290, 291

[56] References Cited

U.S. PATENT DOCUMENTS

| | | | |
|---|---|---|---|
| 2,434,845 | 1/1948 | Gaffney | 263/44 |
| 3,745,667 | 7/1973 | Heinemann et al. | 34/20 |
| 4,463,688 | 8/1984 | Andreoli | 110/298 |
| 4,479,441 | 10/1984 | Somodi | 110/257 |
| 4,667,886 | 5/1987 | Unland et al. | 241/23 |
| 4,732,561 | 3/1988 | Eiring et al. | 432/78 |
| 4,762,489 | 8/1988 | Schmits et al. | 432/77 |
| 4,870,913 | 10/1989 | Schneider | 110/281 |
| 4,878,949 | 11/1989 | Unland | 106/100 |
| 5,129,820 | 7/1992 | Kupper et al. | 432/77 |
| 5,149,266 | 9/1992 | Heinemann et al. | 432/77 |
| 5,201,652 | 4/1993 | Kawamura et al. | 432/78 |
| 5,264,013 | 11/1993 | Brentrup | 95/128 |
| 5,322,434 | 6/1994 | Milewski et al. | 432/78 |
| 5,330,350 | 7/1994 | Tegtmeier | 432/77 |
| 5,437,721 | 8/1995 | Kupper et al. | 106/739 |

*Primary Examiner*—Teresa J. Walberg
*Assistant Examiner*—Gregory A. Wilson
*Attorney, Agent, or Firm*—Deveau, Colton & Marquis

[57] ABSTRACT

A method and apparatus for preventing the accumulation of fines and the resulting formation of snowmen in a clinker cooler by applying short duration blasts of high pressure, high velocity air from openings in the cooler inlet grate. The cleaning air can be selectively supplied to a portion or portions of the cooler inlet grate. Monitoring may be provided to aid in the selective application of the cleaning air.

26 Claims, 5 Drawing Sheets

METHOD AND APPARATUS FOR PREVENTING FORMATION OF SNOWMEN AND REMOVING LUMPS OF COATING IN CLINKER COOLERS

This application is a continuation of application Ser. No. 08/573,222, filed Dec. 15, 1995, now abandoned.

BACKGROUND OF THE INVENTION

1. Field of the Invention

The present invention relates generally to a method and apparatus for preventing the formation of snowmen within a clinker cooler. The invention relates more specifically to a method and apparatus which allow the monitoring and selective application of short duration blasts of high-pressure, high-velocity air through openings in the stepped supporting surface of a clinker cooler, jostling the clinker and thereby disrupting the accumulation of fines which grow to form snowmen, and dislodging any such accumulations in the clinker bed.

2. Description of Related Art

In the production of cement, raw materials are combusted to produce cement clinker, typically in a rotary kiln according to known methods. U.S. Pat. No. 5,437,721, to Kupper. et al., for example, describes one method of producing cement clinker from fine-grained cement raw materials.

Kiln temperatures of 1400° C. and above are common in the production of cement clinker. The temperature of the clinker as it is discharged from the kiln is typically approximately 1350° C. As the clinker exits the kiln, it must be cooled rapidly. Most commonly, the hot clinker is discharged from the kiln onto a grate constructed to facilitate the introduction of cooling air to cool the clinker. The clinker is exposed to cooling air while on the cooler inlet grate, and is then typically discharged to a conveyor which transports the clinker to a grinder or milling device.

A variety of cooling grates for cooling cement clinker have been developed and are known in the art. For example, U.S. Pat. No. 2,434,845 to Gaffney shows a clinker cooling chamber including a stepped grating onto which the hot clinker is discharged from the kiln. As the clinker moves downwardly, by gravity, along the grate, cooling air is introduced into the clinker pile through openings in the stepped surface.

Similarly, U.S. Pat. No. 4,732,561 to Eiring, et al. shows a cooling apparatus wherein hot material such as clinker, discharged from a kiln, is conveyed by gravity over a step-like series of air-permeable carrier elements. Cooling air is introduced to the material through the carrier elements, and may be delivered in pulses to individual carrier elements or groups of carrier elements.

The clinker typically discharged from a kiln is generally spherical and approximately one to three inches in diameter. Along with the clinker, "fines" are discharged from the kiln into the clinker cooler. These fines comprise smaller particulate matter and can cause a number of undesirable effects within the clinker cooler. For example, the fines can cling to the surfaces of adjoining pieces of clinker in the cooler and cause the clinker to clump together. This is referred to as agglomeration or caking. Also occasionally discharged from the kiln are large lumps of coating which have broken loose from the interior surface of the kiln. These large lumps interfere with effective heat transfer within the cooler and disrupt clinker flow through the cooler.

U.S. Pat. No. 4,870,913 to Schneider seeks to prevent caking in the clinker cooler by providing a grate cooler comprising stepped layers of grate plates, the forward facing surfaces of the grate plates having nozzle-shaped cooling air openings oriented to inhibit caking between the grate plates. Because the air supplied to its nozzle openings is drawn from the cooling air supply, Schneider is intended to prevent caking of clinker in localized areas. Schneider's air flow is insufficient to jar or shock the clinker itself, and is unable to dislodge fines which have already adhered to the clinker.

A more severe problem than that of caking of the clinker is the formation of "snowmen" in the clinker cooler. Snowmen are formed when fines fall from the kiln above, onto the top surfaces of large lumps of kiln coating on top of the clinker bed within the cooler. Snowmen also sometimes form on the top surfaces of the clinker, especially when the clinker cakes together. As layer after layer of the fines fuse onto the lump of kiln coating, snowmen "grow" upwardly into stalagmite-like structures. In effect, the lumps of kiln coating act as "seeds" for the formation of snowmen. Left unchecked, these snowmen may eventually grow to reach the mouth of the kiln, thereby blocking the discharge of clinker from the kiln.

To date, several attempts have been made to prevent the formation of snowmen. For example, U.S. Pat. No. 5,330,350 to Tegtmeier, et al. discloses a reciprocating grate cooler having a hydraulic mechanism for driving the cooler inlet grate in a reciprocating manner. It is also known to provide a rotating ram and thrust bar, such as that shown by U.S. Pat. No. 4,732,561 to Eiring, et al., which is mechanically driven to break-up any deposits or encrustations on the clinker.

These and other known methods and devices have been found less than entirely satisfactory to remove lumps of kiln coating from the cooler inlet, or to prevent the formation of snowmen. This is, in part, because such devices suffer the disadvantage that, by their nature, they inherently incorporate moving parts. Due to the weight of the clinker and its abrasive nature, these moving parts are highly susceptible to wear and breakage, especially at the high temperatures commonly encountered within the cooler. Moreover, the presence of fines from the kiln within the cooler environment can lead to the clogging and jamming of moving parts. Also, because the large lumps of kiln coating tend to float or ride on the surface of the clinker bed, reciprocating scrapers or thrust bars, which operate entirely beneath the surface of the clinker bed, are incapable of removing them from the cooler inlet.

It has also been proposed to direct pulses of high pressure air onto the clinker from openings in the cooler walls or in refractory walls within the cooler. In some instances, this has proven successful in shearing off the tops of snowmen in the immediate vicinity of the air openings. The lower portions of the snowmen, however, remain in place on the clinker bed and serve as seeds for the formation of new snowmen. Furthermore, because the air openings are located generally at the outer periphery of the cooler, the air pulses are unable to affect snowmen or other accumulations nearer to the center of the cooler. Also, except for air pulses from openings in the headwall at the back of the cooler, it is not possible for such an apparatus to direct air pulses in the direction of clinker flow. This limits the ability of such devices to move large lumps of kiln coating any significant distance from the headwall. This arrangement also suffers the disadvantage that, once the air openings are provided in the cooler walls, their position is fixed. As the depth of the clinker bed varies, the location of these openings may render them ineffective.

Thus, it can be seen that there exists a need for a method of preventing the formation of snowmen by removing lumps of kiln coating from the cooler inlet. A need further exists for a method of dislodging snowmen, once formed, during cooling. Likewise, a need exists for the provision of an apparatus capable of carrying out these methods, without the need for moving parts, and which is not affected by variations in the depth of the clinker bed.

It is to the provision of such a method and apparatus that the present invention is primarily directed.

SUMMARY OF THE INVENTION

Briefly described, in a preferred form, the present invention comprises a method for preventing the accumulation of fines forming snowmen, during the cooling of cement clinker. The method comprises the steps of feeding the hot clinker to a cooling grate, applying low-pressure cooling air to the clinker, and the improvement characterized by directing blasts of high-pressure cleaning air of a selected duration, from the cooler inlet grate into the clinker bed, generally horizontally in the direction of clinker flow, to shock or jar the clinker, thereby dislodging any incipient accumulations or agglomerations and conveying any large lumps of kiln coating away from the kiln inlet. The method can further include the monitoring of the clinker within the cooler and the selective application of cleaning air to chosen portions of the cooler inlet grate at selected blast intensities.

The present invention also comprises an apparatus for preventing not only caking, but the formation of snowmen during the cooling of cement clinker. In a preferred form, the apparatus of the present invention comprises a cooler inlet grate having a stepped surface for supporting the clinker, a low-pressure cooling air supply system for applying cooling air to the clinker, and additionally, a separate high-pressure cleaning air supply system for directing short duration blasts of high pressure cleaning air of selected intensity into the clinker pile. The apparatus can also include monitoring means and control means for the selective application of cleaning air to the clinker.

Accordingly, it is an object of the present invention to provide a method for preventing the accumulation of snowmen and removing large lumps of kiln coating from the cooler inlet during the cooling of cement clinker.

It is another object of the present invention to provide an apparatus for preventing the formation and accumulation of snowmen during the cooling of cement clinker, which apparatus eliminates or minimizes the necessity of moving parts in and around the clinker.

A further object of the present invention is to provide a method and apparatus for the cooling of cement clinker, whereby short duration blasts of high pressure air are applied to the clinker to jar or shock the clinker, and thereby prevent the creation of snowmen within the clinker cooler and dislodge snowmen once formed.

Still another object of the present invention is provide a method and apparatus for positively effecting flow of the static clinker bed by discharging bursts of high pressure cleaning air from the cooler inlet grate, generally horizontally and in the direction of clinker flow.

Yet another objective of the present invention is to provide a method and apparatus whereby short duration blasts of high pressure air may be selectively applied to a portion or portions of the clinker cooler.

Another object of the present invention is to provide a method and apparatus capable of selectively varying the intensity of the blasts of cleaning air applied to the clinker.

Still another object of the present invention is to provide a method and apparatus allowing monitoring of the clinker within the clinker cooler to permit the selective application of high pressure air to that portion of the cooler when and where the accumulation of snowmen is observed.

It is yet another object of the present invention to provide a method and apparatus for the cooling of cement clinker which is durable and reliable in operation, and simple and economical in manufacture, installation and repair.

These and other objects, features, and advantages of the present invention will become more apparent upon reading the following specification in conjunction with the accompanying drawing figures.

DESCRIPTION OF THE DRAWING FIGURES

DETAILED DESCRIPTION

Figure 1:
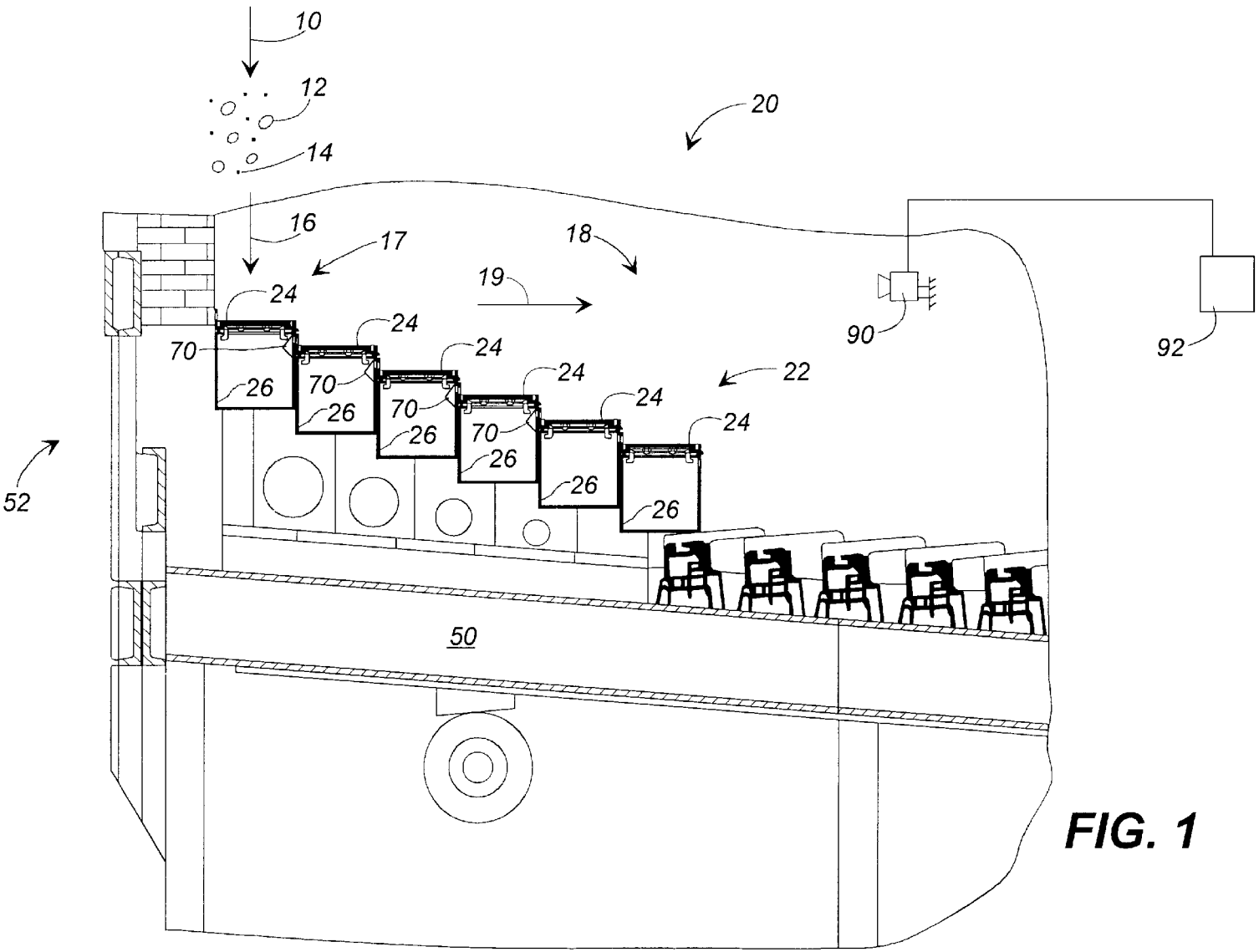
FIG. 1 is a side elevation, in partial cross section, showing a clinker cooler according to a preferred form of the present invention.

Referring now in detail to the drawing figures, wherein like reference numerals represent like parts throughout the several views, FIG. 1 shows a clinker cooler 20 according to a preferred form of the invention. Clinker cooler 20 is arranged beneath kiln discharge 10, and receives hot clinker 12 and fines 14 from a kiln (unshown) at a cooler inlet portion 16. The clinker 12 and fines 14 which enter clinker cooler 20 are supported above a cooler inlet grate 22. The cooler inlet grate 22 slopes downwardly from high end 17 to low end 18 in the direction of arrow 19. The slope of cooler inlet grate 22 is preferably between 10 and 20 degrees downward from the horizontal, and most preferably 14 degrees from the horizontal.

Clinker 12 accumulates into a clinker bed (unshown) on the cooler inlet grate 22. The layer of clinker immediately above the cooler inlet grate 22 typically remains in place, thereby providing cooler inlet grate with a protective layer against the friction and heat of the clinker 12 from the kiln discharge 10. This layer is commonly referred to as the static clinker bed.

Figure 3:
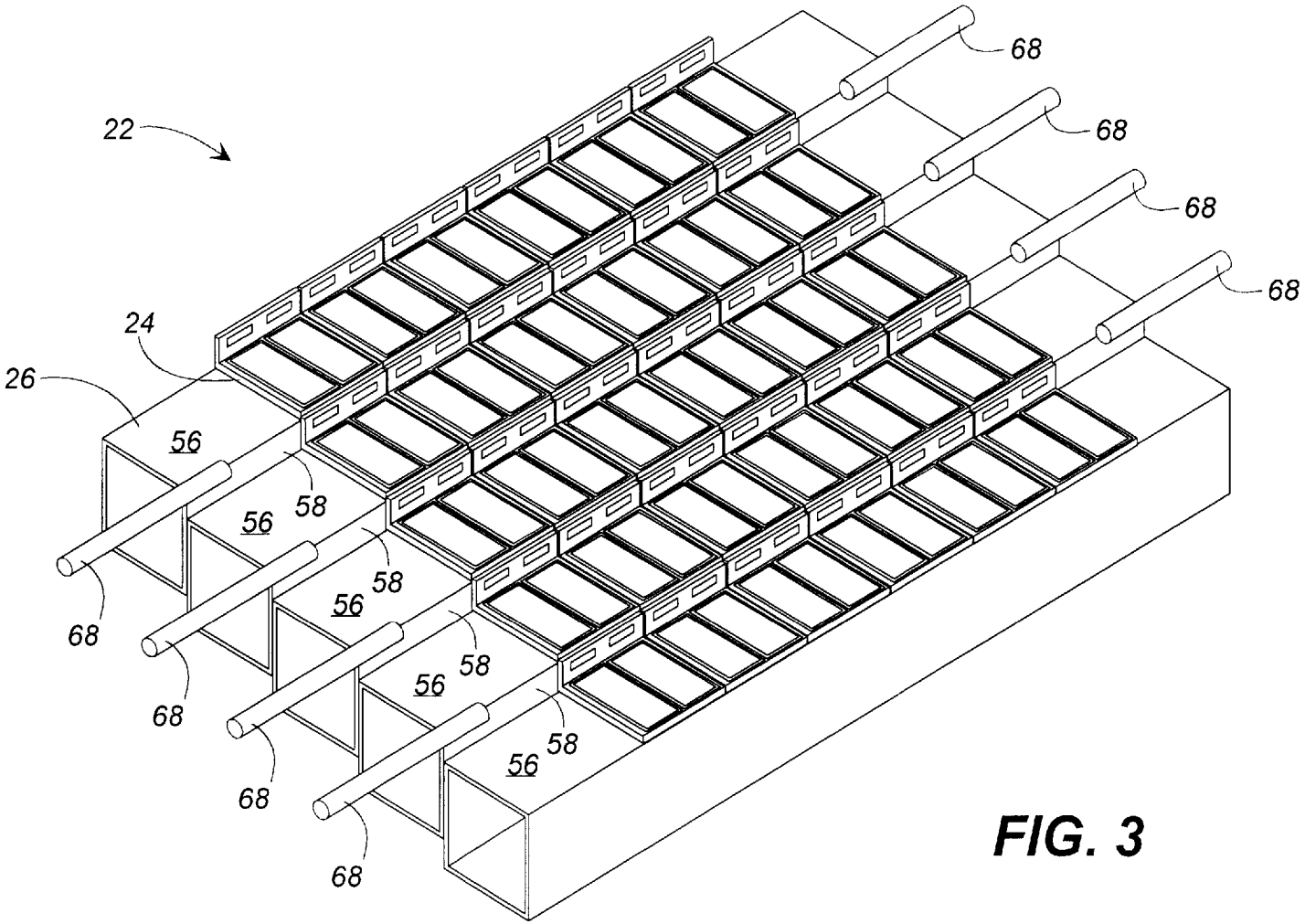
FIG. 3 shows, in greater detail, the cooler inlet grate of the clinker cooler of FIG. 1.
Figure 4:
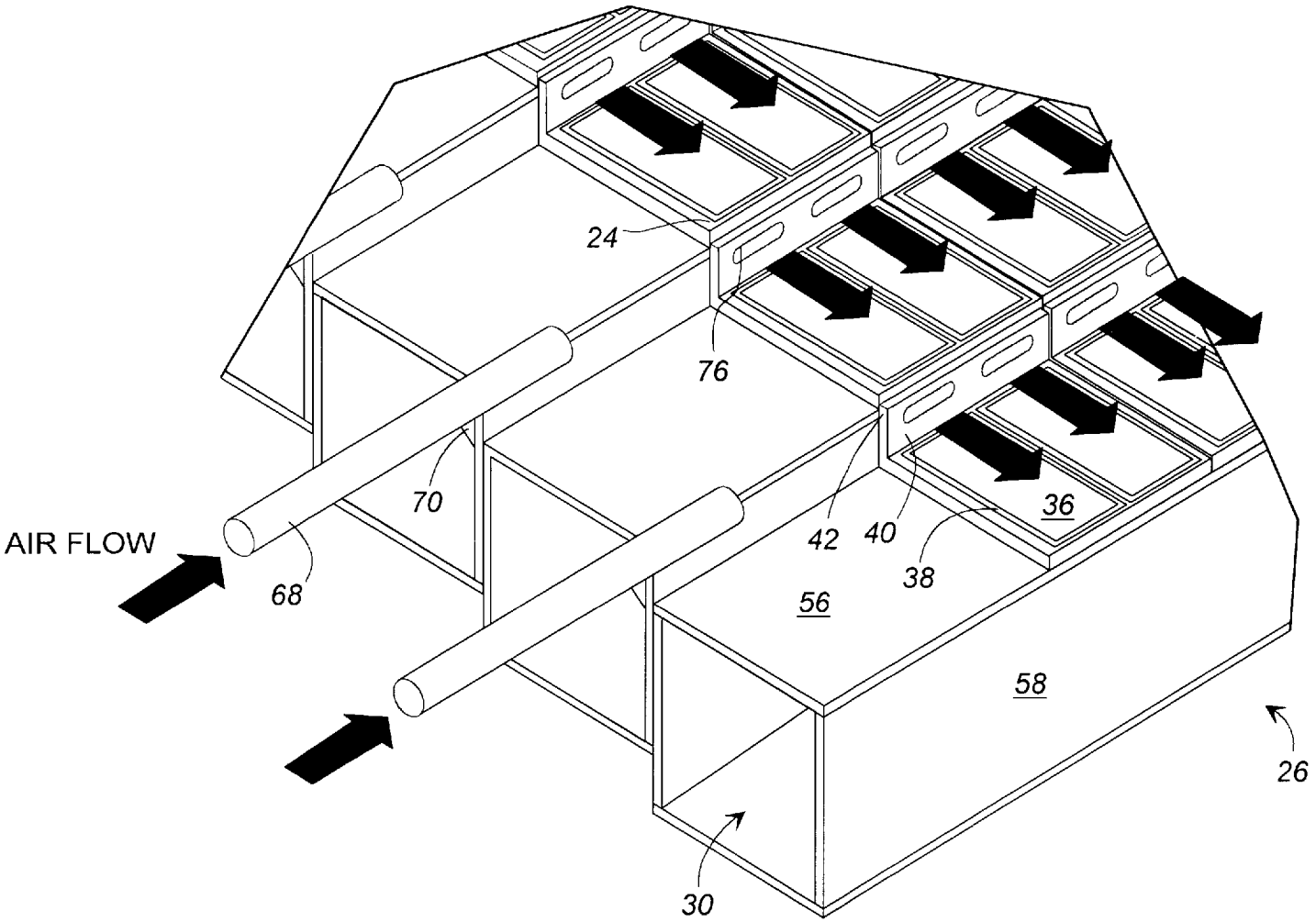
FIG. 4 shows the cleaning air supply to, and the cleaning air flow from a portion of the cooler inlet grate shown in FIG. 3.
Figure 5:
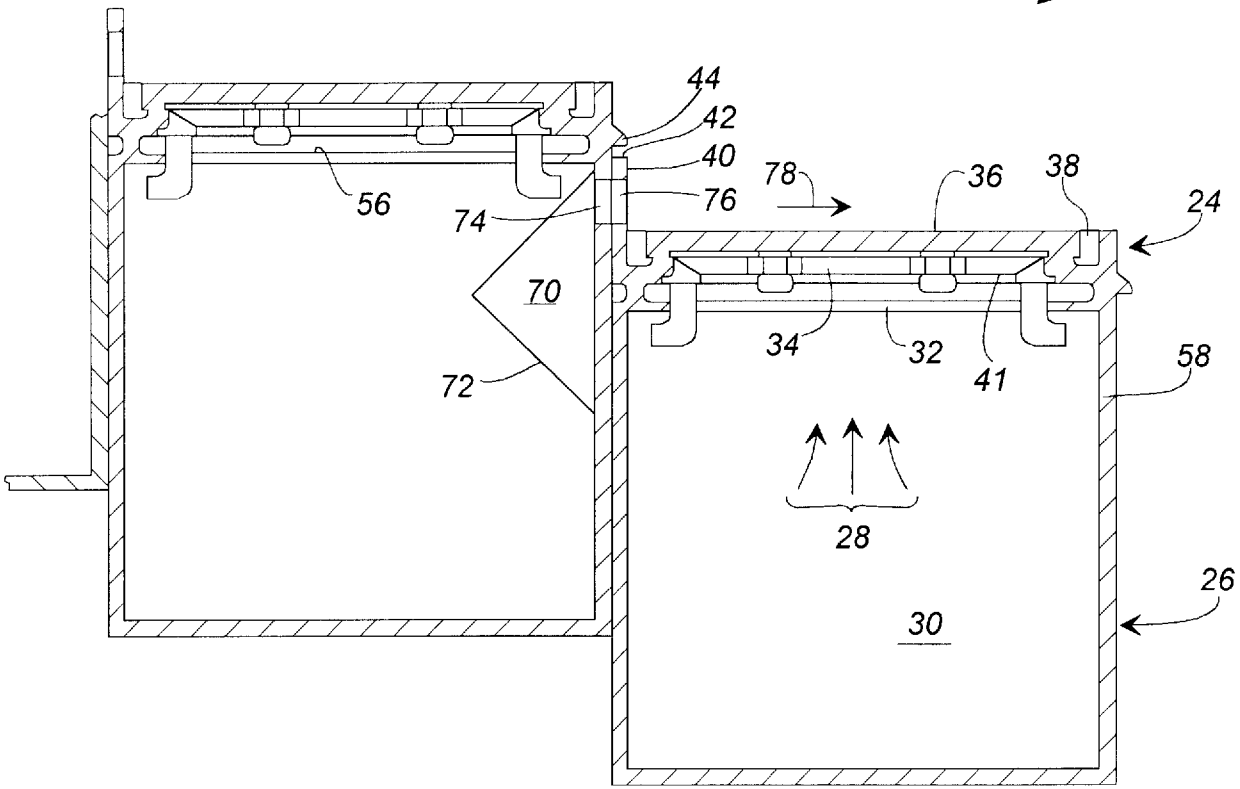
FIG. 5 shows a detailed cross-sectional view of a grate plate, which may form a portion of the cooler inlet grate, according to a preferred embodiment of the invention.

Cooler inlet grate 22 is shown in progressively greater detail by FIGS. 3 through 5. In one preferred form, cooler inlet grate 22 comprises a plurality of rows of removable grate plates 24. Grate plates 24 within each row abut or connect with one another. Grate plates of adjacent rows can be interconnected as shown in greater detail by FIG. 5. This grate plate arrangement is preferably a variation of similar design to that shown by U.S. Pat. No. 5,322,434 to Milewski et al, the teaching of which is incorporated herein by reference. It will be readily apparent to those of ordinary skill in the art, however, that the present invention is applicable to many other known cooler grating arrangements as well.

Grate plates 24 support the clinker as it accumulates, the clinker commonly having an angle of repose of approximately 30°–35°. The accumulated clinker above the static clinker bed travels downwardly along the cooler inlet grate 22, generally in the direction of arrow 19. Grate plates 24 are supported by grate plate supports 26, which are arranged in step like fashion adjacent one another. The grate plate supports 26, in turn, are supported by a support frame 50 and the adjacent structure 52 as necessary, depending on the specific installation.

FIGS. 4 and 5 show the separate cooling and cleaning air delivery systems of clinker cooler 20 in greater detail. Grate plate 24 comprises an upright grate panel 40 and a grate plate base 41 to form a generally L-shaped element. Grate plate 24 is preferably a casting, and should be of sufficient strength and wear resistance to support the clinker without undue deflection and resist abrasion from the clinker as it moves across the cooler inlet grate. The removable nature of the grate plates 24 facilitates easier replacement and repair of the cooler inlet grate 22. Upright grate panel 40 terminates in an upper lip 42 adapted to fit adjacent lower lip 44 of the adjoining grate plate's base 41 in an overlapping or interlocking fashion. Grate plate base 41 comprises at least one grate plate cooling air opening 34 to permit cooling air to pass therethrough. As shown in greater detail by U.S. Pat. No. 5,322,434, grate plate 24 is adapted to receive an aeration cap 36 over the grate plate cooling air opening 34. In this manner, an annular cooling air slot or gap 38 is formed between the upper surface of grate plate base 41 and the lower surface of aeration cap 36.

Cooling air 28 is supplied at low pressure from an unshown source into cooling air duct 30. "Low pressure," for purposes of the present invention, is defined as below approximately 2 psi. Cooling air duct 30 is provided with at least one cooling air duct opening 32 through which cooling air may pass. Cooling air duct opening 32 is located to align with grate plate cooling air opening 34 when grate plate 24 is installed on the grate plate support 26. In this manner, cooling air 28 is discharged from the cooling air duct 30, through cooling air duct opening 32 and the adjacent grate plate cooling air opening 34, through the annular cooling air slot or gap 38, and around aeration cap 36 to cool the clinker. The cooling air is preferably supplied at a pressure of between approximately 1.1 and 1.8 psi, a velocity of between approximately 60 and 130 ft/sec. and a flow rate of between approximately 200 and 350 a.c.f.m. (actual cubic feet per minute), per plate opening, generally depending upon the volume and nature of the clinker to be cooled and the temperature the clinker is received from the kiln, in order to sufficiently cool the clinker by the time it leaves the cooler.

As seen best in FIG. 4, the grate plate supports 26 are preferably hollow beams of square or rectangular cross-section. Grate plate support 26 can be the same structure utilized as cooling air duct 30, as shown in the figures. Alternatively, separate structures may be utilized, with cooling air duct 30 constructed of piping disposed within a structural framework acting as the grate plate support 26. Grate plate supports 26 are arranged in step-like fashion, and are supported above support frame 50. Each step-like grate plate support further comprises a tread 56 at its top, and a riser 58 forming the vertical face of the stair-like grate plate support 26. When grate plate 24 is installed, its upright grate panel 40 fits adjacent and in close proximity to riser 58, and the grate plate base 41 is adjacent and in close proximity to the tread 56.

Figure 2:
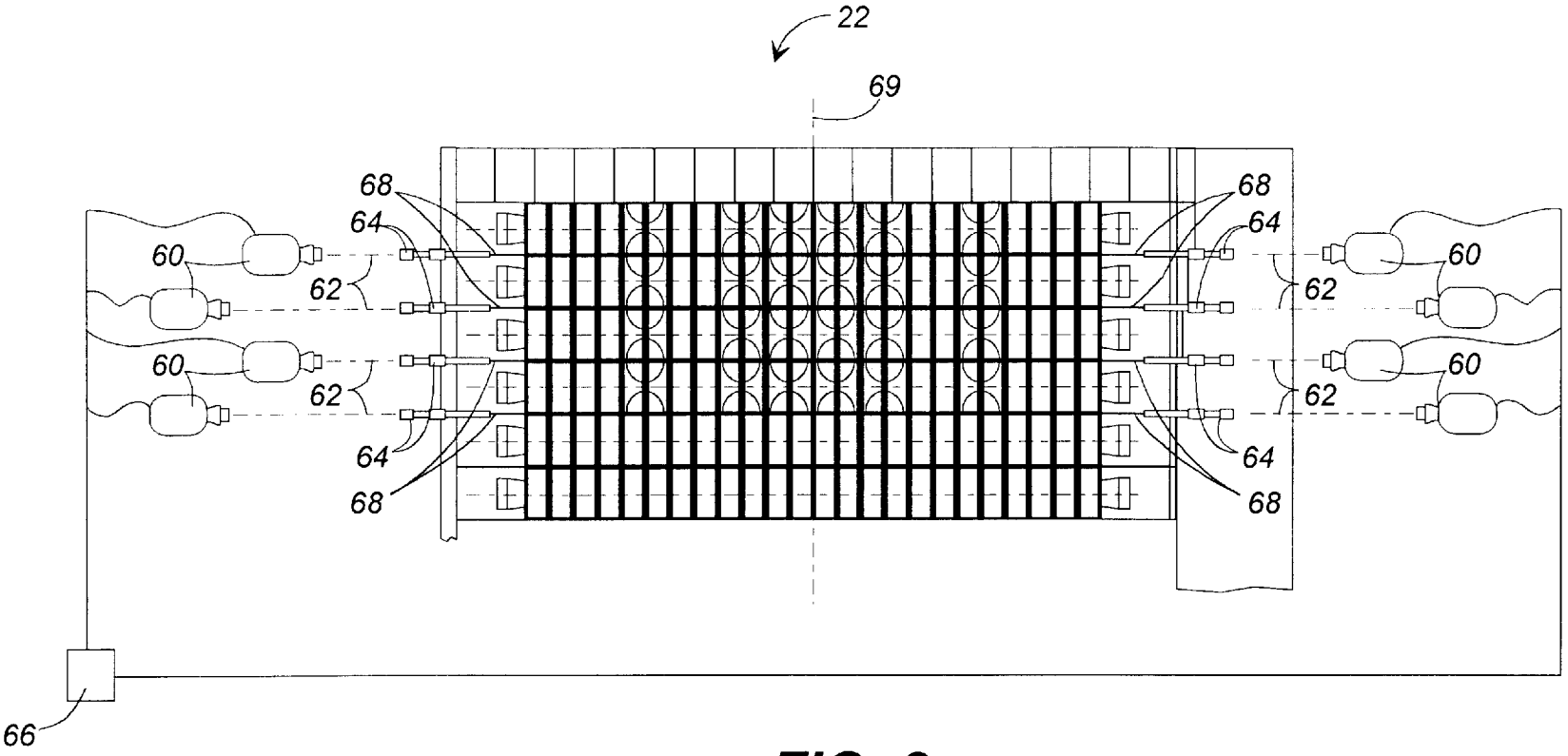
FIG. 2 is a top view of the cooler inlet grate and cleaning air supply portions of the clinker cooler shown in FIG. 1.

In order to prevent the accumulation of fines, to remove any lumps of kiln coating from the cooler inlet, and to dislodge any snowmen which may form, the clinker cooler of the present invention further comprises a high pressure cleaning air system which will now be described in greater detail. "High pressure," for purposes of the present invention, is defined as above 50 psi. As shown by FIG. 2, one or more air cannons 60 supply cleaning air to the clinker cooler's cleaning air system. Air cannons 60 provide short duration (preferably between approximately 0.5–1.2 seconds, and most preferably approximately 0.7 seconds) blasts of high pressure, high velocity air to the cleaning air system. The "on-off" nature of the blasts of cleaning air supplied by the air cannons 60 of the present invention are capable of shocking or jarring the clinker, as opposed to the "pulsed" cooling air supplied by known coolers, which vary the pressure of cooling air applied to the clinker, but which are incapable of shocking or jarring the clinker. An example of a suitable air cannon is a Martin BB4-24-48.

Cleaning air from the air cannons 60 is fed through cleaning air supply lines 62. Cleaning air supply valves 64 may be provided in the cleaning air supply lines 62. Air cannons 60 are preferably remotely operable through pneumatic or electronic control means such as remote air cannon controller 66.

As shown best in FIGS. 3–5, the cleaning air from air cannons 60 feeds through cleaning air feed conduit 68 into the cleaning air plenum 70. Cleaning air plenum 70 is preferably constructed by attaching a length of angle-iron 72 to the interior surface of the riser portion 58 of the grate plate support 26 as shown in FIG. 5. The angle-iron cleaning air plenum is preferably attached to the grate plate support by a continuous weld, thereby providing an airtight seal. Cleaning air plenum orifices are provided through the riser 58 in spaced apart positions where cleaning air is to be discharged.

Slots 76 in the upright grate panel 40 of the grate plates 24 align with the cleaning air plenum orifices 74 to permit cleaning air to be discharged from cleaning air plenum 70 into the clinker pile in the direction of arrow 78. By aligning slots 76 such that the cleaning air is discharged in a generally horizontal direction, the energy of the cleaning air blast is substantially entirely transferred to the clinker pile. This promotes more effective dislodging of any accumulation of snowmen. Moreover, a horizontal orientation of slots 76 assists in propelling the static clinker bed along the cooler inlet grate 22. Preferably slots 76 are approximately three inches wide by one-half inch high, with two slots provided on each grate plate 24 which delivers cleaning air.

The cleaning air supply system described above should be capable of supplying cleaning air in short duration bursts at an elevated pressure of at least between approximately 50 and 100 psi, a velocity of at least between approximately 330 and 660 ft/sec., and a flow rate of at least between approximately 40 and 60 $ft^3$/sec. A variety of commercially-available air cannons are capable of adequately supplying cleaning air according to these parameters, as will be known to those of ordinary skill in the art. To provide air blasts meeting these criteria, it is necessary to provide a cleaning air supply which is independent from the cooling air supply and an independent cleaning air distribution system capable of operating at pressures of approximately 10 to 50 times that of the cooling air system. In this way, the pressures and velocities provided by the cleaning air through slots 76 are elevated significantly above the pressures and velocities of the cooling air provided to clinker through grate plate openings 34.

By selectively operating one or more of the air cannons 60, cleaning air can be supplied to selected sections or zones of the cooler inlet grate 22. Air cannon controller 66 allows the remote manipulation of the air cannons 60 for the selective application of the cleaning air. By providing separate cleaning air plenums on the right and left sides of the center line 69 of the cooler inlet grate 22, the cooler inlet grate can be further segregated so that cleaning air can be directed to selected zones of the cooler inlet grate 22. For example, in the configuration shown in FIG. 2, cleaning air can be selectively applied to any of eight zones (four left and four right of center line 69), corresponding to each air cannon 60. Alternatively, the cleaning air plenum 70 can be continuous from one side of the cooler inlet grate 22 to the other, or can be provided with removable air dams or valving enabling the segregation of the cleaning air plenum into any desired number of zones.

Although FIGS. 3 and 4 show every grate plate 24 provided with a slot 76, it will be understood that this is not necessary. As represented in FIG. 2 by the portions of the cooler inlet grate having an "X" shown thereon, slots 76 may be provided in only selected grate plates 24 as necessary to supply cleaning air blasts to dislodge any accumulation of fines within the cooler. It is desirable, however, to provide a sufficient number and distribution of grate plates 24 with cleaning air slots 76 to allow the application of cleaning air over substantially the entire width of the cooler inlet grate 22. The placement of these grate plates will necessarily vary, depending on factors such as the geometry and size of the cooler inlet grate 22.

By varying the number of grate plates 24 which are provided with cleaning air slots 76, the intensity of the cleaning air blasts may be selectively varied. For example, if all grate plates 24 are provided with cleaning air slots 76, the cleaning air from air cannons 60 will be distributed approximately equally over the width of cooler inlet grate 22. With this arrangement, the intensity of the blast of cleaning air supplied from any given cleaning air slot 76 will be minimized. If half of the grate plates 24 are supplied with cleaning air slots 76, the intensity of the cleaning air blast from any given slot will be approximately double the minimum intensity described above. On the other hand, if only one grate plate 24 is supplied with a cleaning air slot 76, the cleaning air blast intensity from that single slot will be maximized.

It is also possible to selectively vary the intensity of the blast of cleaning air discharged to the clinker by means of selective valving. For example, one or more air cannons could be used to supply cleaning air to a common manifold supplying more than one cleaning air supply line. By appropriately opening or closing selected cleaning air supply valves, blasts of cleaning air could be directed to one or more cleaning air feed conduits, fewer conduits resulting in a greater cleaning air blast intensity being provided.

To aid in the selective application of cleaning air to the clinker, monitoring means, such as an infrared camera 90 can be provided in the clinker cooler 20 as shown by FIG. 1. Alternatively, temperature monitoring, a standard closed-circuit video camera, or even a window or view-hole may be utilized as the monitoring means. By providing a remote monitor 92 for the infrared camera 90, an operator can monitor the clinker cooler from a remote location. If the development of snowmen is observed, the operator can selectively apply blasts of cleaning air to the zone of the cooler inlet grate where the accumulation is observed by means of the remote cleaning air valve controller 66. Alternatively, mechanical or electronic control means or a timer can be provided to sequentially or randomly apply bursts of cleaning air to the various zones of the cooler inlet grate 22.

In operation, the kiln discharge 10, including clinker 12 and fines 14, is deposited onto the cooler inlet grate 22 and travels downward along the grate, generally in the direction of arrow 19. As the clinker moves along the cooler inlet grate 22, it is cooled by low pressure cooling air 28 discharged into the clinker as described above. If remote monitoring is provided, an operator can generally observe the progress of the clinker to detect the formation of any snowmen. If any such formations are observed, the operator, through the use of remote air cannon controller 66, can selectively apply bursts of high pressure cleaning air to the appropriate zone of the cooler inlet grate 22. These bursts of cleaning air are discharged from openings in the riser portions of the stepped cooler inlet grate 22.

The cleaning air is discharged from the cooler inlet grate at grate level, generally horizontally and in the direction of clinker flow. The bursts of cleaning air are of sufficient intensity to shock or jostle the clinker, thereby disrupting the stability of the clinker bed and causing any snowmen which have formed to topple and tumble down the slope of the clinker bed, breaking up the snowman. The direction and point of discharge of the cleaning air also positively effect flow of the static clinker bed. Also, because the blasts of cleaning air are discharged at grate level, the air expands as it absorbs heat while traveling through the hot clinker bed, thereby increasing the intensity of the air blasts.

The blasts of cleaning air also propel any lumps of kiln coating entering the clinker cooler away from the cooler inlet in the direction of clinker flow, thereby eliminating the "seeds" which could potentially grow into snowmen. Moreover, these results are obtained without the necessity of moving parts in the vicinity of the clinker cooler.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. An apparatus for cooling hot material including fines, said apparatus comprising:

a. a cooler inlet grate for supporting said material and having cooling air openings and cleaning air openings separate from said cooling air openings;

b. a low pressure cooling air supply for supplying cooling air to said cooling air openings; and c. a selectively operable high pressure cleaning air supply, separate from said low pressure cooling air supply for supplying cleaning air to at least one of said cleaning air openings separately from the cooling air at a pressure sufficiently high enough to dislodge accumulation of the fines on the hot material.

2. The apparatus of claim 1 wherein said cooler inlet grate comprises a stepped surface further comprising at least one tread portion and at least one riser portion.

3. The apparatus of claim 2 wherein said cooling air openings are provided in said at least one tread portion, and said cleaning air openings are provided in said at least one riser portion.

4. The apparatus of claim 3 wherein said cleaning air openings are aligned to direct said cleaning air outward from said at least one riser portion in a generally horizontal direction.

5. The apparatus of claim 3 wherein said cooler inlet grate further comprises a plurality of removable grate plates.

6. The apparatus of claim 1 wherein said high pressure cleaning air supply comprises at least one air cannon.

7. The apparatus of claim 6 wherein said at least one air cannon supplies said cleaning air to said cleaning air openings in blasts of less than 1 second in duration, at a pressure of between approximately 50 and 100 psi, at a velocity of between approximately 330 and 660 ft./sec., and at a flow rate of between approximately 40 and 60 $ft^3$/sec.

8. The apparatus of claim 6 wherein said cooler inlet grate is segregated into at least two zones and said high pressure cleaning air supply further comprises a number of cleaning air supply conduits, each of said conduits supplying cleaning air from said at least one air cannon to one of said zones.

9. An apparatus for cooling hot material including fines, said apparatus comprising:

a. a cooler inlet grate segregated into at least two zones for supporting said material and having cooling air openings and cleaning air openings separate from said cooling air openings:

b. a low pressure cooling air supply for supplying cooling air to said cooling air openings; and c. a high pressure cleaning air supply for supplying cleaning air to said cleaning air openings separately from the cooling air comprising at least one air cannon and a number cleaning air supply conduits, each of said conduits supplying cleaning air from said at least one air cannon to one of said zones, and wherein said at least one air cannon is remotely operable to supply said cleaning air to one or more of said zones.

10. The apparatus of claim 9 further comprising monitoring means for viewing said hot material and allowing a selective application of said cleaning air to one or more of said zones.

11. The apparatus of claim 8 further comprising a timing means for operating said at least one air cannon to supply said cleaning air to one or more of said zones.

12. The apparatus of claim 8 wherein said cleaning air is supplied in blasts having intensities which can be selectively varied by varying the number of said cleaning air openings.

13. A method for cooling hot material including fines in a cooler, said method comprising:

a. providing a grate within said cooler, the grate being provided with a cooling air opening and a separate cleaning air opening;

b. feeding said hot material onto the grate within said cooler;

c. discharging cooling air into said cooler from a low pressure cooling air supply through the cooling air opening in the grate to cool said material; and d. applying cleaning air from a separate selectively operable high pressure cleaning air supply through the cleaning air opening in the grate to said material in blasts of less than 1.2 second in duration, at a pressure of at least 50 psi, and at least a velocity of 330 ft/sec sufficient to shock or jar the hot material and to thereby dislodge said fines from said material.

14. The method of claim 13 wherein said cleaning air is supplied in blasts of less than 1 second in duration, at a pressure of between approximately 50 and 100 psi, at a velocity of between approximately 330 and 660 ft./sec., and at a flow rate of between approximately 40 and 60 $ft^3$/sec.

15. The method of claim 14 wherein said cleaning air is directed outward from the grate in a generally horizontal direction.

16. The method of claim 13 further comprising applying said cleaning air to one or more zones of said grate.

17. A method for cooling hot material including fines in a cooler, said method comprising:

a. feeding said hot material onto a grate within said cooler;

b. discharging cooling air into said cooler from a low pressure cooling air supply to cool said material;

c. applying cleaning air to one or more zones of said grate from a high pressure cleaning air supply through the grate to said material to dislodge said fines from said material; and d. monitoring said material within said cooler and selectively applying said cleaning air to said one or more zones of said grate.

18. The method of claim 17 further comprising the selective variation of the intensity at which said cleaning air is applied.

19. The method of claim 16 wherein said application of cleaning air to said one or more zones of said grate is controlled by a timing means.

20. An apparatus for preventing accumulation of fines within a cooler for cooling cement clinker, said apparatus comprising:

a. means for monitoring said cooler to detect the location of any accumulation of fines within said cooler;

b. a cleaning air supply system within said cooler for delivering blasts of cleaning air to the cooler; and c. means for segregating said cleaning air supply system into at least two zones and permitting the delivery of said blasts of cleaning air to only those zones where the accumulation of fines is observed.

21. The method of claim 13, further comprising isolating the cleaning air from the cooling air until the cleaning air is applied to the material.

22. An apparatus for cooling hot material including fines, said apparatus comprising:

a. a stepped grate comprising at least one generally horizontal tread and at least one generally vertical riser said grate supporting the hot material and transporting a portion of the hot material in a first direction;

b. a low-pressure air system for cooling the hot material, said low-pressure air system delivering cooling air at a first pressure to at least one opening, provided in said at least one generally horizontal tread of said grate; and c. a high-pressure air system for dislodging accumulations of the fines on the hot materials, said high-pressure air system delivering bursts of air at a second pressure through a high-pressure plenum to at least one opening provided in said at least one generally vertical riser of said -rate, wherein said high-pressure plenum prevents the bursts of air delivered by said high-pressure air system from mixing with the cooling air delivered by said low pressure air system until the bursts of air and the cooling air are introduced into the hot material.

23. The apparatus of claim 22, wherein said second pressure is at least 50 psi.

24. The apparatus of claim 22, wherein said high-pressure air system comprises at least one air cannon.

25. The apparatus of claim 24, wherein said stepped grate is segregated into at least two zones, and wherein said high-pressure air system comprises at least two high-pressure plenum segments, each zone of said grate being delivered bursts of air through an associated high-pressure plenum segment.

26. The apparatus of claim 25 further comprising monitoring means for observing said hot material and allowing a selective application of the bursts of air from one or more of said high-pressure plenum segments to one or more of said zones.

* * * * *